United States Patent [19]

Laverty et al.

[11] 4,409,924

[45] Oct. 18, 1983

[54] SELF-ADJUSTING PLATING MASK

[75] Inventors: Gerald C. Laverty, Santa Clara; Michael Seyffert, Santa Cruz, both of Calif.

[73] Assignee: National Semiconductor Corporation, Santa Clara, Calif.

[21] Appl. No.: 394,216

[22] Filed: Jul. 1, 1982

[51] Int. Cl.[3] ..... B05C 5/02

[52] U.S. Cl. ..... 118/406; 118/411; 118/504; 204/224 R

[58] Field of Search ..... 118/406, 411, 412, 721; 226/55, 56, 57, 58; 118/504, 505; 271/226, 232; 204/15, 224 R

[56] References Cited

U.S. PATENT DOCUMENTS 4,294,680 10/1981 Lincoln et al. ..... 204/224 R 4,364,977 12/1982 Bernardi ..... 427/429

*Primary Examiner*—John P. McIntosh

*Assistant Examiner*—Mary Beth Calligaris

*Attorney, Agent, or Firm*—Paul J. Winters; Michael J. Pollock; Gail W. Woodward

[57] ABSTRACT

In a system for plating precisely located spots on an intermittently moved strip of metal, a spring loaded pawl on the spot defining mask is positioned to grasp holes in the strip and move just the mask a short distance with the strip so as to insure mask alignment with the strip.

9 Claims, 4 Drawing Figures

SELF-ADJUSTING PLATING MASK

BACKGROUND OF THE INVENTION

One way of spot plating a strip of metal is to guide the strip through a plating head. The strip is intermittently advanced a certain distance. When it stops, the plating head clamps the strip so that plating electrolyte may be washed against the surface of the strip from passageways in the plating head. In the prior art, a compliant masking material is mounted on the plating head so as to define the exact areas on the strip that are to be plated. The mask has openings of precise size, shape, and location so that electrolyte is channeled from the plating head passageways only to areas on the strip that are exposed in these openings. However, if the strip is to be plated in the exact right spot, it is necessary that the strip always be positioned correctly relative to the mask when the strip comes to rest. To accomplish this in the prior art, it was necessary to have some mechanism to ascertain the relative position of the strip and the plating head and additional mechanisms to move either the strip or the plating head so as to achieve the correct position.

An example of such a set of mechanisms may be found in U.S. patent application Ser. No. 06/280,597, filed July 6, 1981 by Carl E. Bernardi, entitled Automatic Self-Adjusting Processing apparatus, and assigned to the assignee of this application. It is therein described how the quantity of air passing through indexing holes in the strips of metal is used to determine the misalignment of the strip. This information is then used by a control mechanism that mechanically adjusts the plating head back and forth until the correct location is established. Such a system is accurate but complex and expensive. The present invention is much less complicated and thus less expensive.

SUMMARY OF THE INVENTION

Briefly, this invention contemplates a movable pawl mounted on the plating mask that is moved into engagement with the indexing holes in the strip of metal just as the strip is completing its movement. This causes the mask to float with the strip during the last small increment of strip movement and come to rest in the correct alignment with the strip. Since the strip is generally too fragile to move the entire plating head, the mask is constructed as a separate lightweight structure than can slide a short distance relative to the overall plating head. With the mask thus automatically aligning itself with the strip, it is no longer necessary to measure the relative position of the strip and the plating head nor to provide apparatus to move the plating head or the strip so as to achieve alignment.

DESCRIPTION OF THE PREFERRED EMBODIMENT

Figure 1:
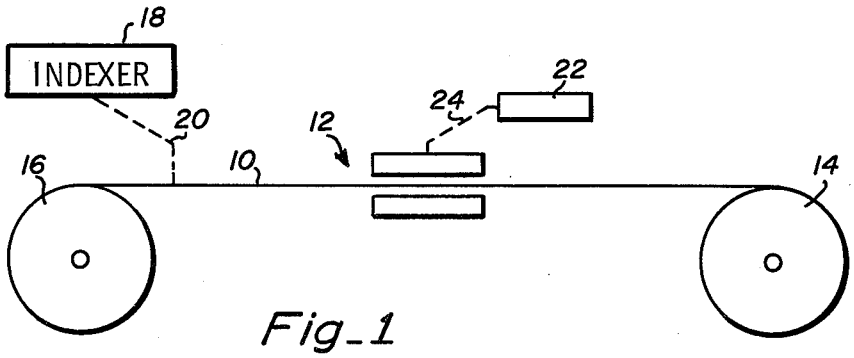
FIG. 1 shows a typical prior art transport system for a strip spot plating system.

FIG. 1 shows schematically how a strip of metal 10, such as a web of semiconductor lead frame, is fed between a pair of plating heads 12 from a supply roll 14 and onto a take up roll 16. Strip 10 is periodically advanced by a suitable indexer or moving means 18 connected to strip 10 by any appropriate mechanical connection 20. Opening and closing mechanisms 22 act through mechanical connections 24 of conventional design to open and close plating heads 12 so as to clamp strip 10 during the intervals when strip 10 is not moving. During these intervals, when strip 10 is tightly clamped, electrolyte is conveyed through passageways in the plating head into contact with selected portions of the strip. The structure to do this is well known to those skilled in the art.

Figure 2:
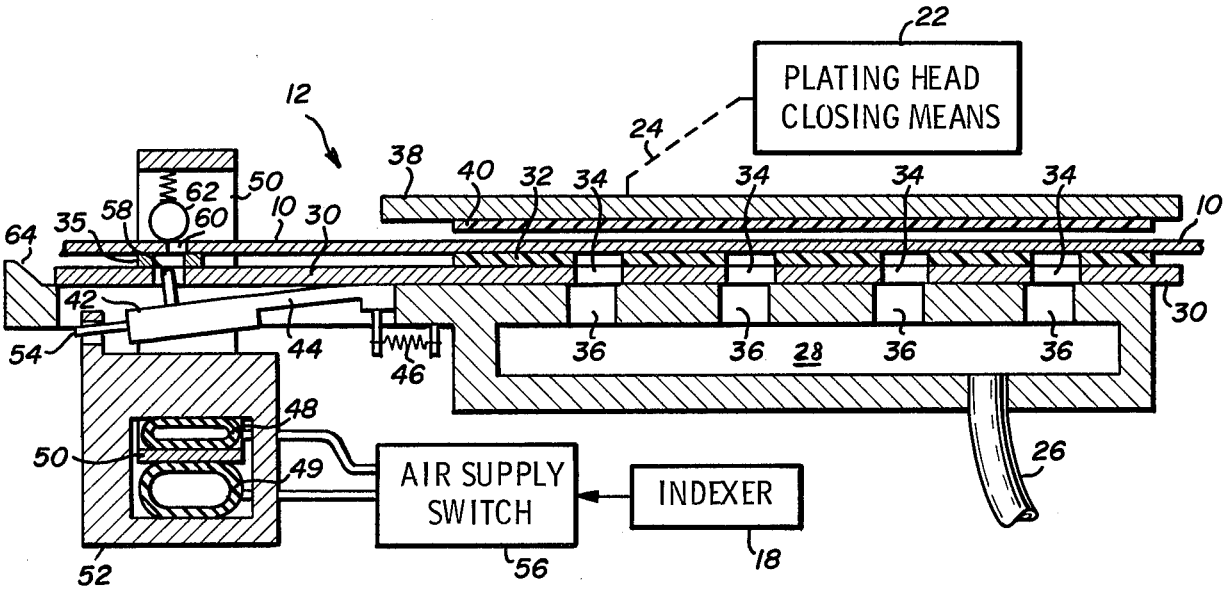
FIG. 2 schematically shows the new self-adjusting plating mask and plating head in section.

In FIG. 2, the plating head arrangement of the present invention is diagrammed in a somewhat simplified form. Electrolyte plating solution is provided through one or more tubes 26 to a chamber 28. A movable mask 30 is positioned for slidable movement in head 12. Mask 30 includes a small spacer 35, a compliant masking material layer 32, and holes 34 which define the areas on strip 10 that are to be contacted by plating solution from chamber 28. Holes 34 are initially offset until pulled by strip 10 into approximate alignment with passageways 36 in head 12.

FIG. 2 shows a simple opposite clamping member 38 with a compliant layer 40 thereon that moves against strip 10 when strip 10 is being plated so as to seal the surface of strip 10 in areas that are not to be plated. Member 38 could be replaced with another movable mask and another set of passageways so as to also plate the other side of strip 10 as discussed with reference to FIG. 4.

Mounted to mask 30 is a strip engaging pawl member 42 with a thinner portion 44 to allow flexing of member 42. Member 42 is shown flexed downward in FIG. 2. A spring 46 between member 42 and head 12 normally urges mask 30 to the right in FIG. 2, relative to head 12. Member 42 is moved up and down by a suitable activating mechanism which, in this case, comprises an air operated bladder 48 for upward movement and a similar air bladder 49 for downward movement. Bladders 48 and 49 bear against a bracket 50 that is affixed to head 12. A connecting member 52 surrounds bladders 48 and 49 and also accepts a pin 54 on the end of member 42. If bladder 48 is inflated from a switched source 56, while bladder 49 is deflated, member 52 moves upward and urges member 42 upward as well. Conversely, when bladder 49 is inflated and bladder 48 allowed to deflate, members 52 and 42 move downward to the position shown in FIG. 2. The upward and downward directions recited herein refer only to the drawing. The actual head may operate in any orientation, the strip actually running vertically on edge in the preferred embodiment.

A small pin 58 on member 42 is aligned in such a way as to engage strip 10 by entering one of a series of holes 60 in strip 10. The sequence of operation is as follows. When indexer 18 advances strip 10, the strip engaging member 42 is held down during some of the advance. When the strip has completed enough of the advance to insure that pin 58 will enter the correct hole 60, switch 56, responding to a signal from conventional timing or position measuring means in indexer 18, operates to inflate bladder 48 and deflate bladder 49 and thus raise pin 58 against strip 10 and a spring loaded roller 62. As strip 10 nears the end of its advance, pin 58 enters hole 60. Mask 30 then moves the strip 10, against the action of spring 46, so as to keep holes 34 in exact alignment with the desired locations on strip 10. Hence, although the main bulk of plating head 12 remains stationary, the mask 30 itself is free to float with the strip and maintain precise alignment therewith. Next plating head 12 closes about strip 10 and plating is carried out in the normal way. With strip 10 securely clamped by head 12, pin 58 may be withdrawn at any time during the plating cycle. For example, a simple timing circuit could be used to cause switch 56 to inflate bladder 49 and deflate bladder 48 so as to retract pin 58 from hole 60. After plating is completed, indexer 18 again advances the strip to bring a new set of plating areas into head 12 and once again pin or panel 58 is urged into engagement with another hole 60 so as to shift mask 30 into the correct position.

In the event that strip 10 is moved too far, or pin 58 remains in hole 60, a small ramp 64 at the end of head 12 lifts mask 30 off of pin 58 so as to avoid damage to the mechanism and the strip. To facilitate the movement of strip 10 on and off pin 58, a spring loaded roller 62 is provided. One possible version of this roller may be seen in FIG. 3.

Figure 3:
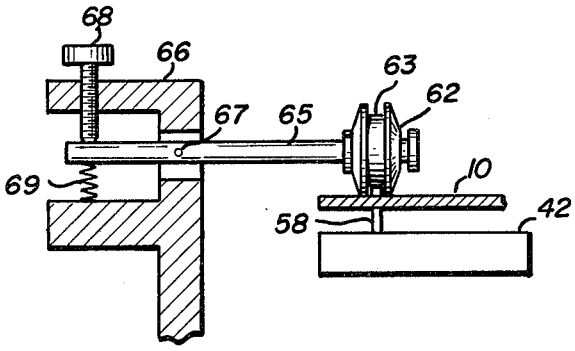
FIG. 3 shows a fragmentary view of one type of guide roller design useful in the preferred embodiment.

FIG. 3 shows how roller 62 includes a circumferential slot 63 to accommodate the portion of pin 58 that extends through strip 10. Roller 62 may be carried at the end of a shaft 65, pivoted on a bracket 66 about a pivot pin 67. A spring 69 bears against shaft 65 so as to urge roller 62 downward. Thus, roller 62 insures that strip 10 will engage pin 58 when pin 58 is moved into the path of strip 10 by member 42. However, the downward movement of roller 62 is limited by a set screw 68 so that mask 30 is never subjected to excessive friction as it slides between strip 10 and the plating head.

Figure 4:
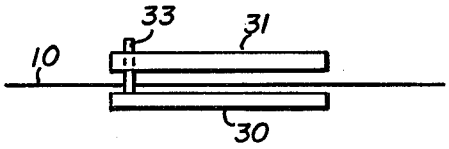
FIG. 4 diagrams an alternative embodiment in which two masks float with the strip.

FIG. 4 demonstrates one way in which masks on both sides of strip 10 may be aligned with the desired plating areas. The lower mask 30, as described with respect to FIG. 2, floats with strip 10 by means of an engaging pawl such as pin 58. Somewhere on mask 30, an alignment pin 33 is mounted so as to extend past strip 10 and through a hole in the second mask 31. Mask 31 can slide on pin 33 toward and away from mask 30, and therefore the masks 30 and 31 may still clamp strip 10. Pin 33, however, insures that mask 31 will move horizontally with mask 30 and thus also be properly aligned with strip 10.

We claim:

1. Plating apparatus suitable to plate the surface of a strip of metal comprising:

strip moving means connected to intermittently move the strip;

a plating head adapted to receive the strip therethrough, said head including passageways adapted to contain and direct plating electrolyte against the strip;

masking means disposed between said plating head and said strip, operable to define the areas of the strip that are to be contacted by electrolyte from said passageways, said masking means being movable relative to the plating head;

strip engaging means mounted on said masking means, operable upon movement to engage the strip at known locations;

activating means connected to said engaging means and to said strip moving means, said activating means operable to move said engaging means into engagement with the strip just as the strip is completing a movement so as to move said masking means with said strip and in predetermined alignment with said strip.

2. The apparatus of claim 1 in which said engaging means comprises a pin movably mounted on said masking means in position to enter selected holes in said strip.

3. The apparatus of claim 1 including spring means connected between said plating head and said masking means operable to urge the masking means towards a first position, said masking means being moved to a second position upon being engaged by said strip engaging means, said second position being positioned relative to the strip, when the strip completes a movement, such that the masking means is in proper alignment with the desired areas on the strip that are to be plated.

4. The apparatus of claim 3 in which said engaging means comprises a pin movably mounted on said masking means in position to enter selected holes in said strip.

5. The apparatus of claim 4 including springable rolling means positioned against the strip in a location opposed to said strip engaging means so as to insure the engagement of the strip with the strip engaging means.

6. The apparatus of claim 5 in which said activating means comprise pressure operated chambers connected to move said engaging means toward and away from said strip.

7. The apparatus of claim 1 including springable rolling means positioned against the strip in a location opposed to said strip engaging means so as to insure the engagement of the strip with the strip engaging means.

8. The apparatus of claim 1 in which said activating means comprise pressure operated chambers connected to move said engaging means toward and away from said strip.

9. The apparatus of claim 1 in which said masking means comprise masks on both sides of said strip, one mask being engaged by said engaging means, and the other mask connected so as to be moved by said one mask.

* * * * *